US006454107B1

(12) United States Patent
Belanger et al.

(10) Patent No.: US 6,454,107 B1
(45) Date of Patent: Sep. 24, 2002

(54) SHIPPING AND DISPLAY CONTAINER

(75) Inventors: Leon Belanger, Windham, ME (US); Patricia Tumminia, Putnam, CT (US); Stacie Santomango, Lewiston, ME (US); Dan Marinone, Holden, MA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/490,274

(22) Filed: Jan. 24, 2000

(51) Int. Cl.[7] ..... A47F 1/04

(52) U.S. Cl. ..... 211/59.3; 312/71; 206/758; 206/556

(58) Field of Search ..... 211/59.3, 51, 132.1, 211/135, 126.6, 126.12; 312/61, 71; 206/730, 758, 556, 805

(56) References Cited

U.S. PATENT DOCUMENTS

| | | | | | |
|---|---|---|---|---|---|
| 1,271,508 | A | * | 7/1918 | Hall | 211/51 |
| 2,538,165 | A | * | 1/1951 | Randtke | 211/51 X |
| 3,166,195 | A | * | 1/1965 | Taber | 211/59.3 X |
| 3,433,546 | A | * | 3/1969 | Cohen | 211/59.3 X |
| 4,197,939 | A | * | 4/1980 | Dogliotti | 206/44 R |
| 5,868,367 | A | * | 2/1999 | Smith | 248/174 |

* cited by examiner

*Primary Examiner*—Daniel P. Stodola
*Assistant Examiner*—Erica B. Harris

(57) ABSTRACT

A tray-shaped shipping and display container has a support surface for supporting items for display. A pusher member is mounted for sliding movement on the support surface, and is elastically biased in a forward direction so that it continually urges items forward in the container to replace items removed from the front of the container by customers.

12 Claims, 9 Drawing Sheets

SHIPPING AND DISPLAY CONTAINER

BACKGROUND OF THE INVENTION

1. Field of the Invention

This invention relates to packaging, and more particularly to a container for shipping and displaying items.

2. Prior Art

There are many known containers for holding a plurality of items for display and sale. Some of these containers are also used for shipping the items from a manufacturer to a retailer, for example. Containers which can be used for both shipping and displaying the items are especially convenient for the retailer, since it is not necessary for the retailer to remove items from a bulk shipping container and place them on a shelf for display. For maximum visual exposure of the items, the container should be constructed so that it exposes to view as much as possible of the items while still supporting the items.

Such containers should also be inexpensive so that they can be disposed of when they are empty.

One disposable container known to applicant suitable for both shipping and displaying items and also providing maximum visual exposure of the items, comprises a tray having a bottom wall and relatively narrow upstanding side walls. The articles are supported on the bottom wall and preferably extend above the side walls. During shipping, the tray loaded with items is placed in an outer container or box to form a shipping package, and when the package reaches its destination, the tray loaded with items is removed from the package and placed on a shelf or other surface for display and sale of the items.

While this prior container satisfactorily functions to ship and display items, it is necessary for the retailer to periodically move items from the back toward the front of the container to replace items which have been removed by customers. This requires constant attention, and if the items are not conveniently positioned at the front of the container, a customer may not want or be able to reach items at the back of the container. Further, if the container is placed on a shelf at eye level or higher, the customer may not be able to see that there are items remaining in the container. In either event, these shortcomings can result in lost sales.

Accordingly, there is need for a simple and inexpensive container that is suitable for shipping and displaying items and which has means for automatically moving items toward the front of the container as items are removed by customers, whereby items remain at the front of the container for maximum visibility and accessibility at all times, without requiring the attention of the retailer.

SUMMARY OF THE INVENTION

The present invention provides a simple and inexpensive container that is suitable for shipping and displaying items and which has means for automatically moving items toward the front of the container as items are removed by customers, whereby items remain at the front of the container for maximum visibility and accessibility at all times.

The container of the invention comprises a tray-like structure having a bottom wall and upstanding side walls, with items supported on the bottom wall and preferably extending above the side walls, although it should be understood that the items need not extend above the side walls or at least not all of them, so long as the items are visible while supported in the container. During shipping and storage the container loaded with items is placed in an outer container or box.

In a preferred construction the container is made from corrugated cardboard and is disposable, although it could be made from other materials if desired. When made from cardboard it is easily folded into an erected condition and is maintained in its erected condition by interlocking panels without requiring the use of adhesive or other fasteners.

Three components, each made from a single blank, are erected and assembled together by the manufacturer or distributor of the items to form the container of the invention, and the items are then loaded into the container, which is then placed in an outer container or box for shipping and storage.

The three components comprise, respectively, a tray having a bottom wall and upstanding side walls, an insert or false bottom that is placed in the tray, and a pusher element that slides along the top of the insert and is constantly urged toward the front of the tray by elastic means connected between the tray and the pusher. When the tray is loaded with items, the pusher is positioned at the back of the tray, behind all of the items, so that as items are removed from the front by customers, the pusher is resiliently urged forward to slide the remaining items forward to replace those removed by customers.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
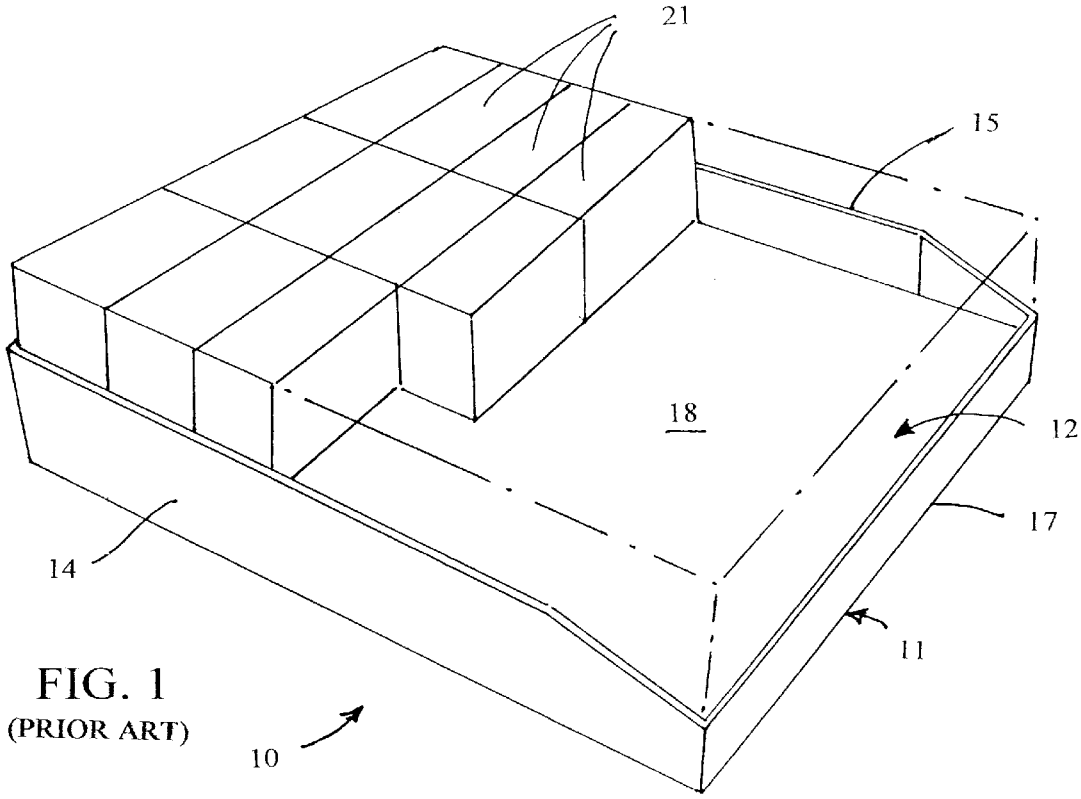
FIG. 1 (PRIOR ART)
FIG. 1 is a front, top perspective view of a prior art shipping and display container with some items remaining in the container.
Figure 2:
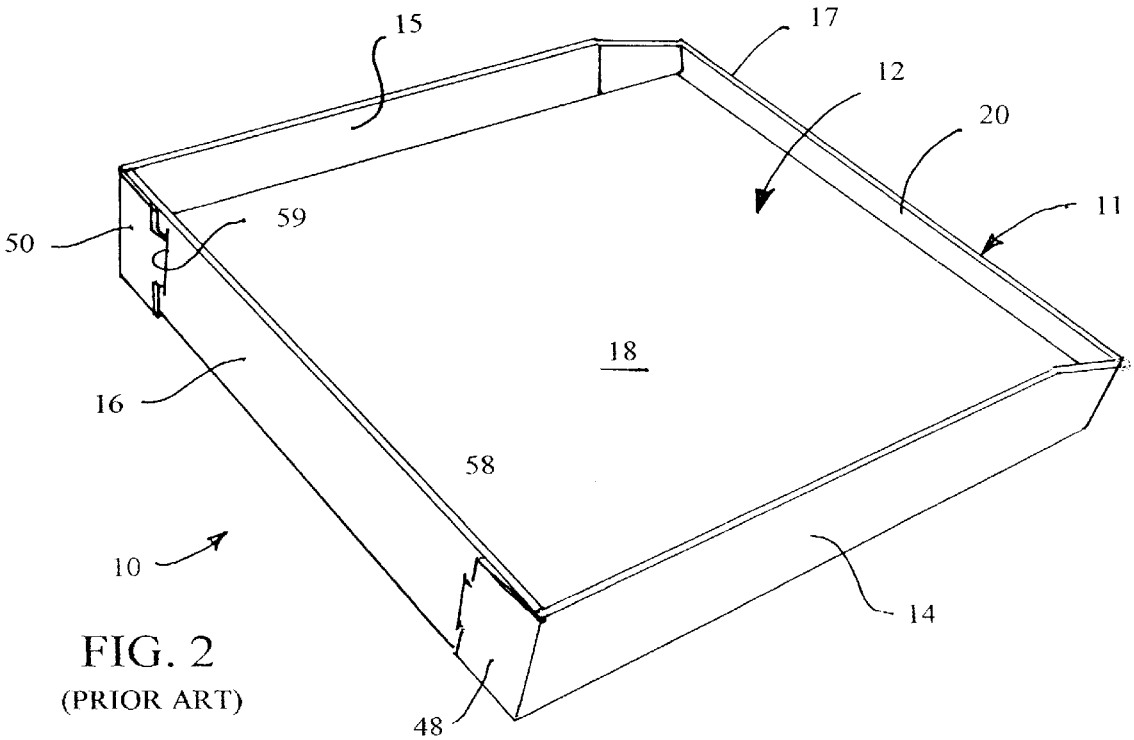
FIG. 2 (PRIOR ART)
FIG. 2 is a rear, top perspective view of the container of FIG. 1, shown empty.
Figure 3:
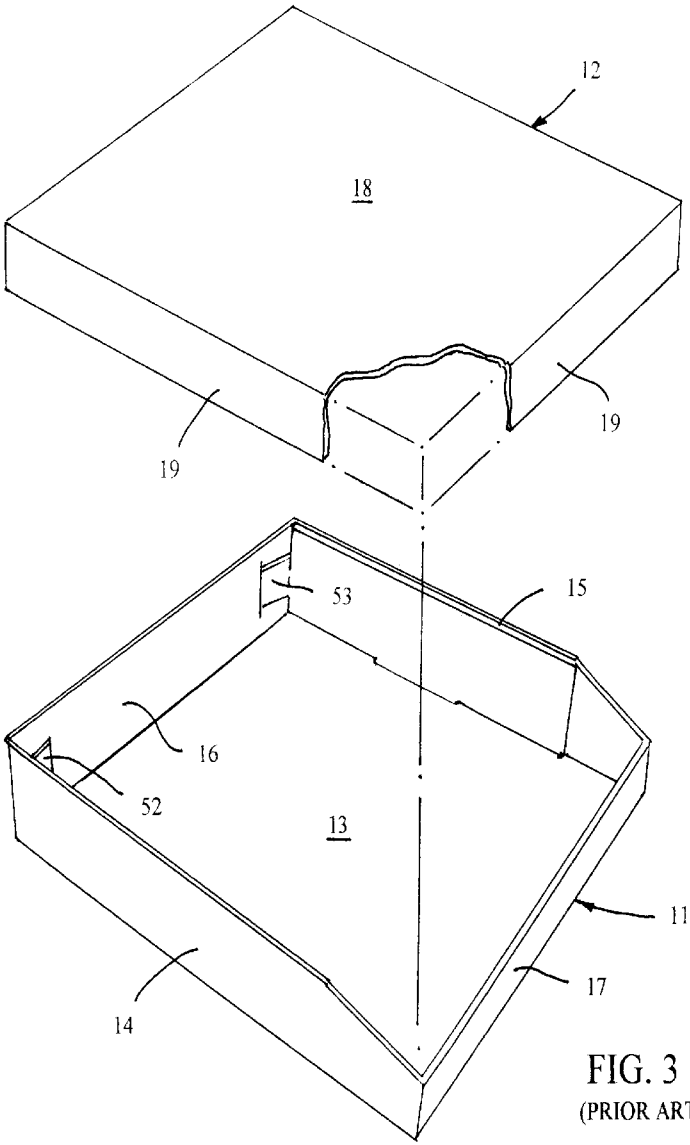
FIG. 3 (PRIOR ART)
FIG. 3 is a front, top exploded perspective view of the container of FIG. 1.

With more specific reference to the drawings, a prior art shipping and display container is indicated generally at 10 in FIGS. 1, 2 and 3. This prior art container comprises a tray 11 and insert 12. The tray has a bottom wall 13, opposite side walls 14 and 15, back wall 16, and front wall 17. It will be noted that the side walls 14,15 and back wall 16 are the same height, while the front wall 17 is slightly shorter.

The insert 12 has a top wall 18 and depending side walls or flanges 19 of uniform height and is positioned in the tray so that the depending flanges 19 support the insert on the bottom wall 13 of the tray, with the top wall 18 of the insert spaced above the bottom wall 13 but below the upper edges of the side walls of the tray. The top wall 18 of the insert extends parallel to the bottom wall 13 of the tray and is generally coextensive therewith, defining a support surface for items placed in the tray. As seen best in FIG. 2, the front wall 17 projects above the insert top wall 18, defining a lip 20.

Although the back and side walls of the tray do not need to be the same height, and the front wall does not need to be shorter, with this arrangement items 21 are adequately supported in the container, with improved accessibility and visibility of the items at the front of the container.

The insert 12 supports the items 21 at a relatively high, more exposed elevation in the tray, assists in holding the tray in its erected condition, and hides from view structural features of the tray.

Further details of construction of the tray are set forth below in connection with the description of the container of the invention, described hereinafter. In this regard, it should be noted that the tray and insert which form a part of the container of the invention are substantially identical to the prior art tray and insert, except that the tray is modified to include connecting means for attaching a member to urge items forwardly in the container. Thus, the tray and insert of the invention may be made on existing machinery, with only very slight modification to produce the connecting means.

Figure 4:
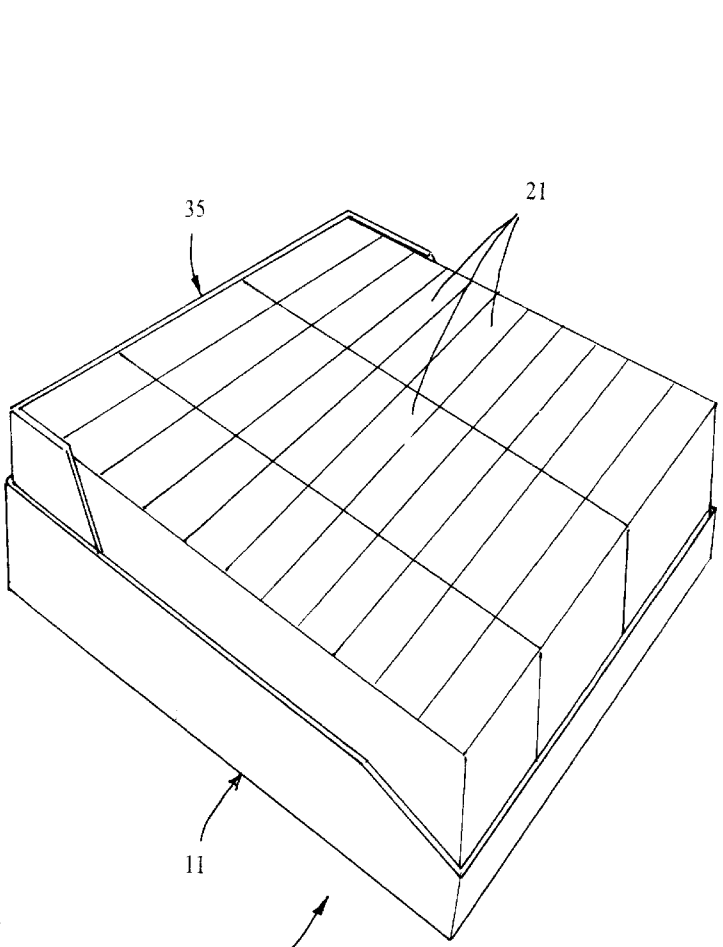
FIG. 4 is a front, top perspective view of a shipping and display container according to the invention, shown full of items to be displayed.
Figure 5:
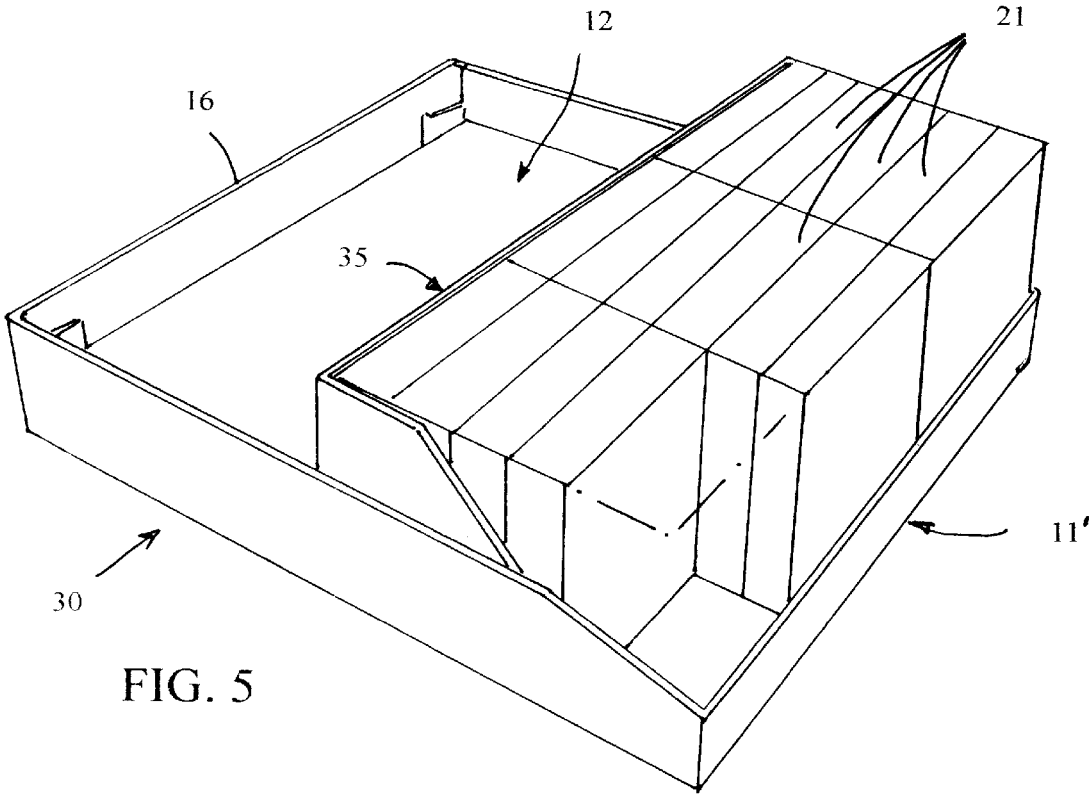
FIG. 5 is a front, top perspective view of the container of FIG. 4, with some of the items removed, and showing how the pusher slides the remaining containers toward the front to replace those removed.
Figure 6:
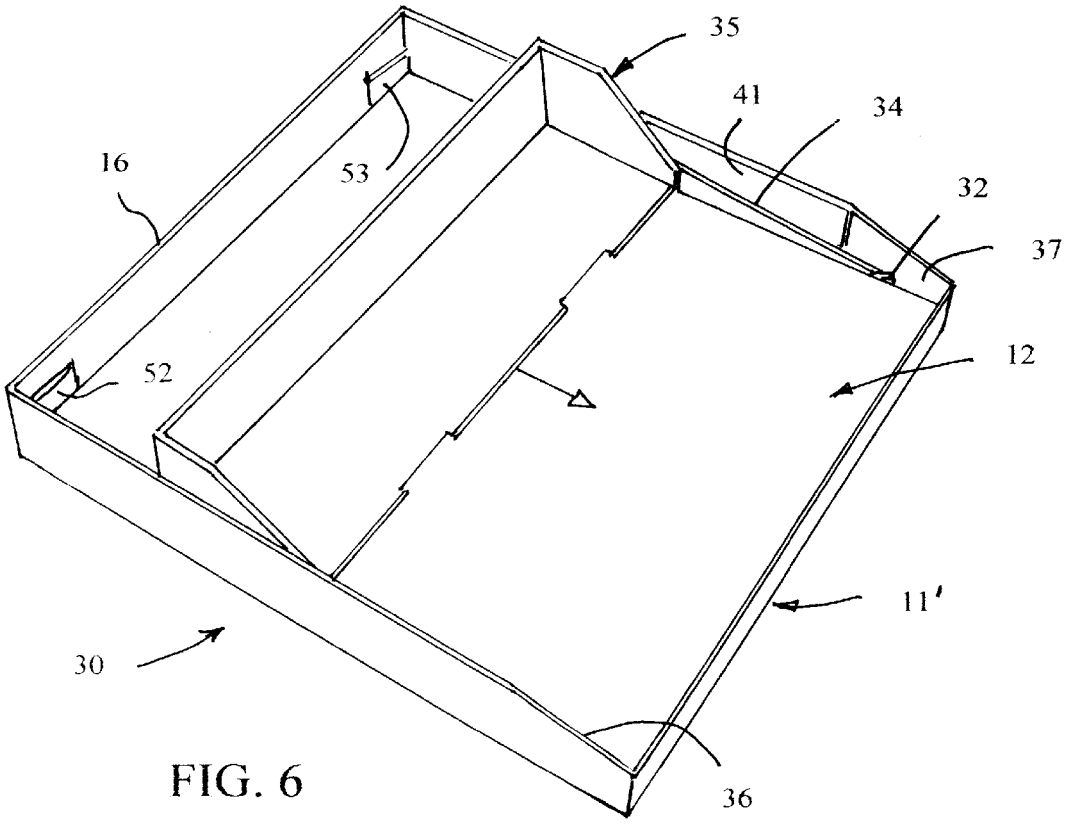
FIG. 6 is a front, top perspective view of the container of FIG. 5, shown empty.
Figure 7:
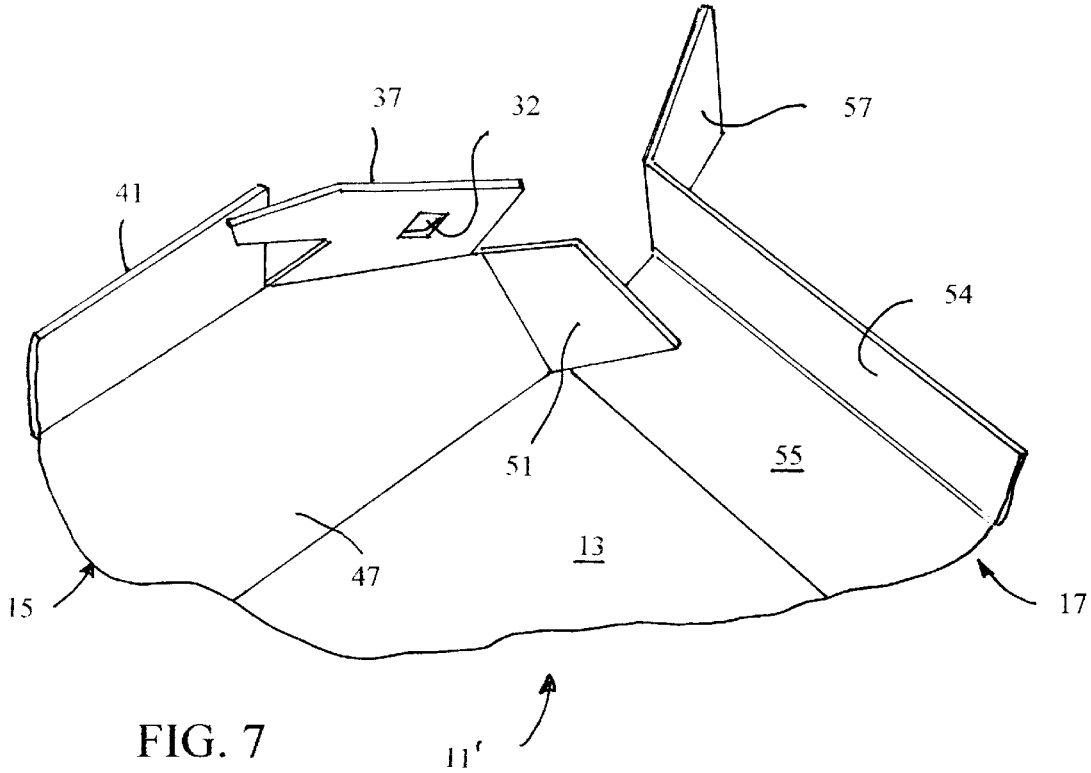
FIG. 7 is an enlarged, fragmentary perspective view of an unfolded left front portion of the container tray of the invention, showing the relationship of the flaps that interlock to hold the front and side walls in erected condition.
Figure 8:
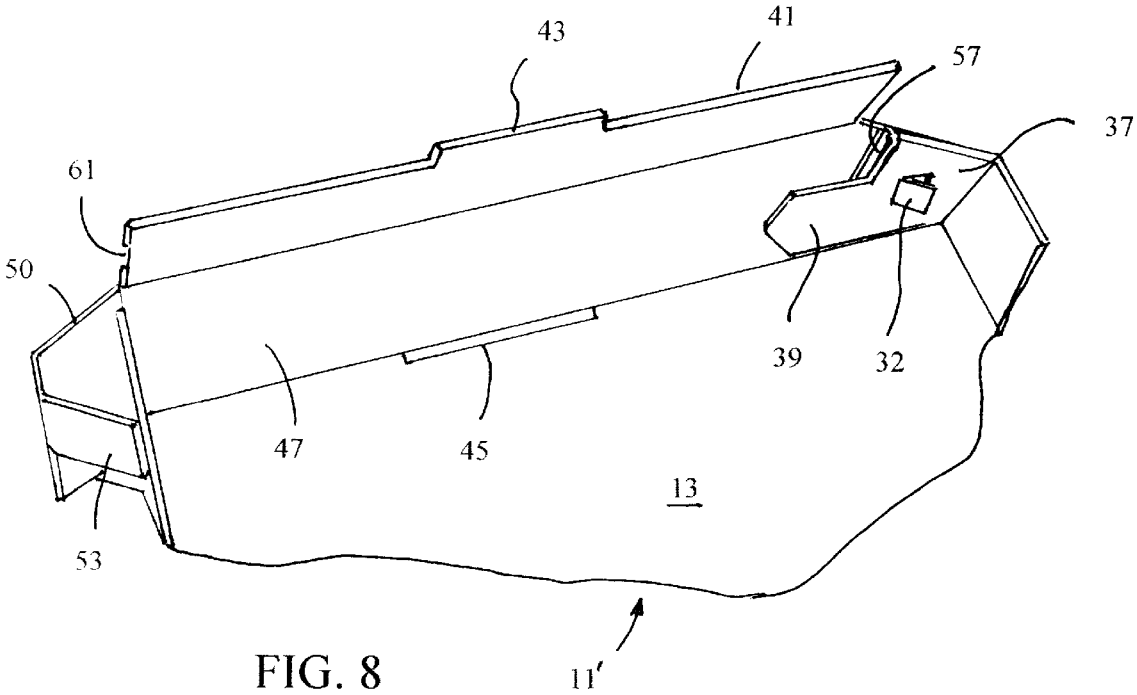
FIG. 8 is a slightly enlarged fragmentary perspective view of one side of the container tray, shown partially folded.
Figure 9:
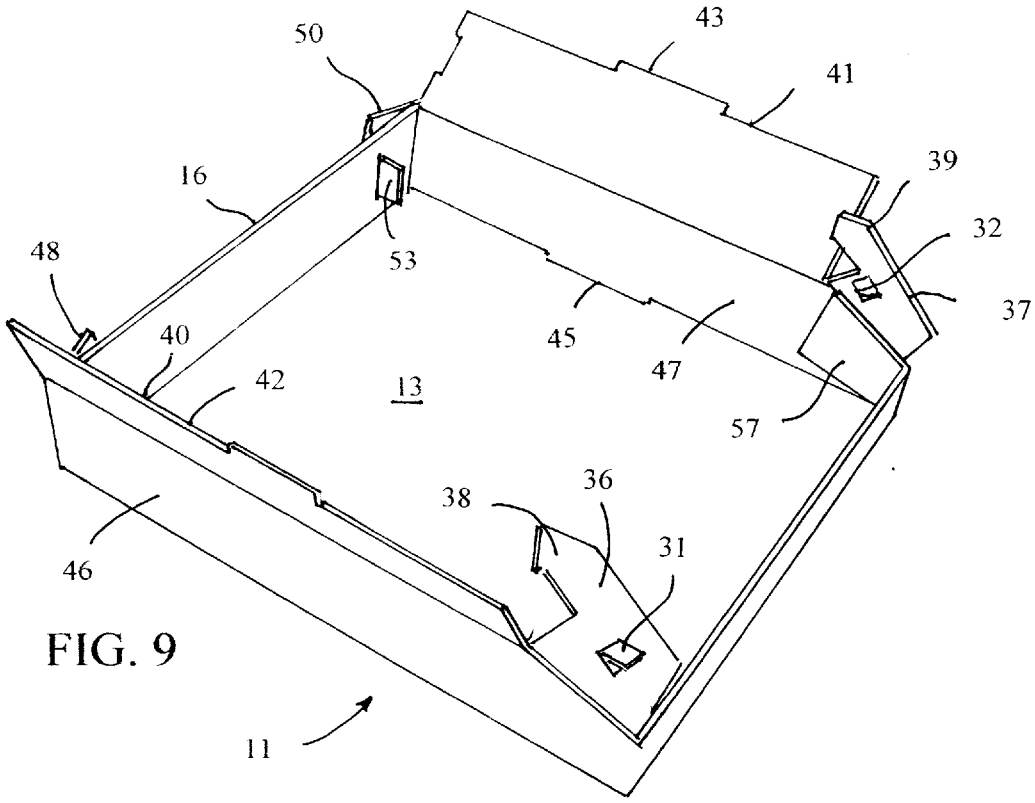
FIG. 9 is a top front perspective view of the tray in a further folded condition.
Figure 10:
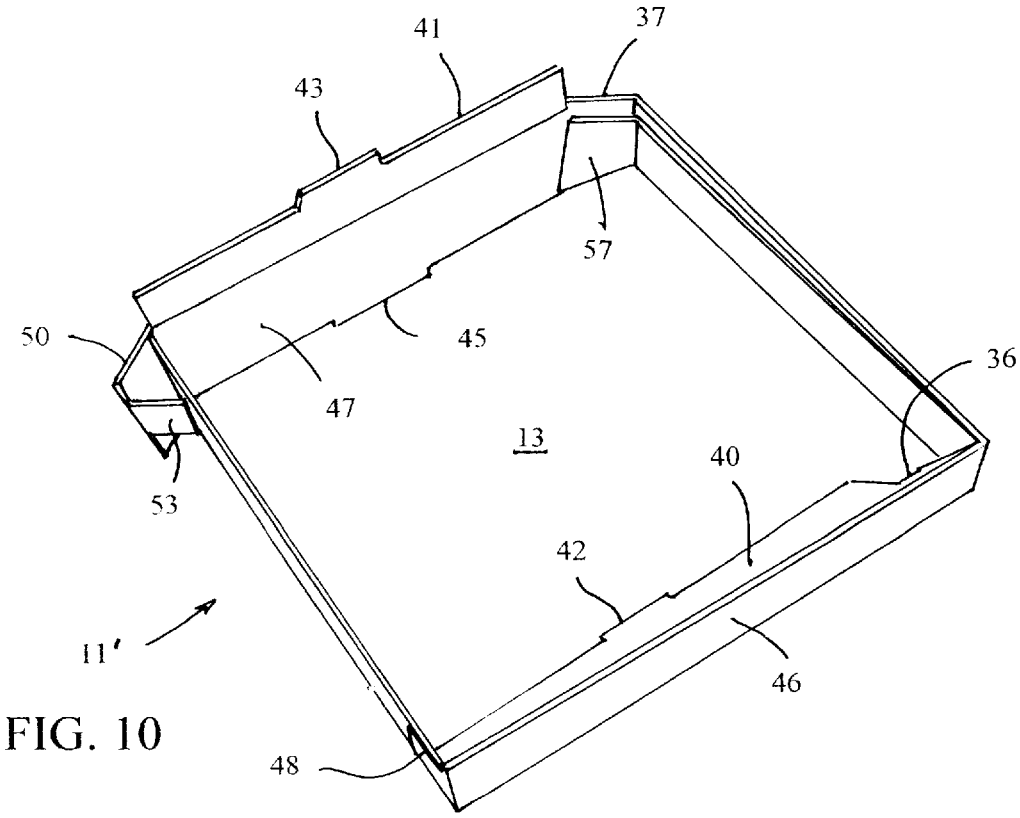
FIG. 10 is a top rear perspective view of the tray, shown in a still further folded condition.
Figure 11:
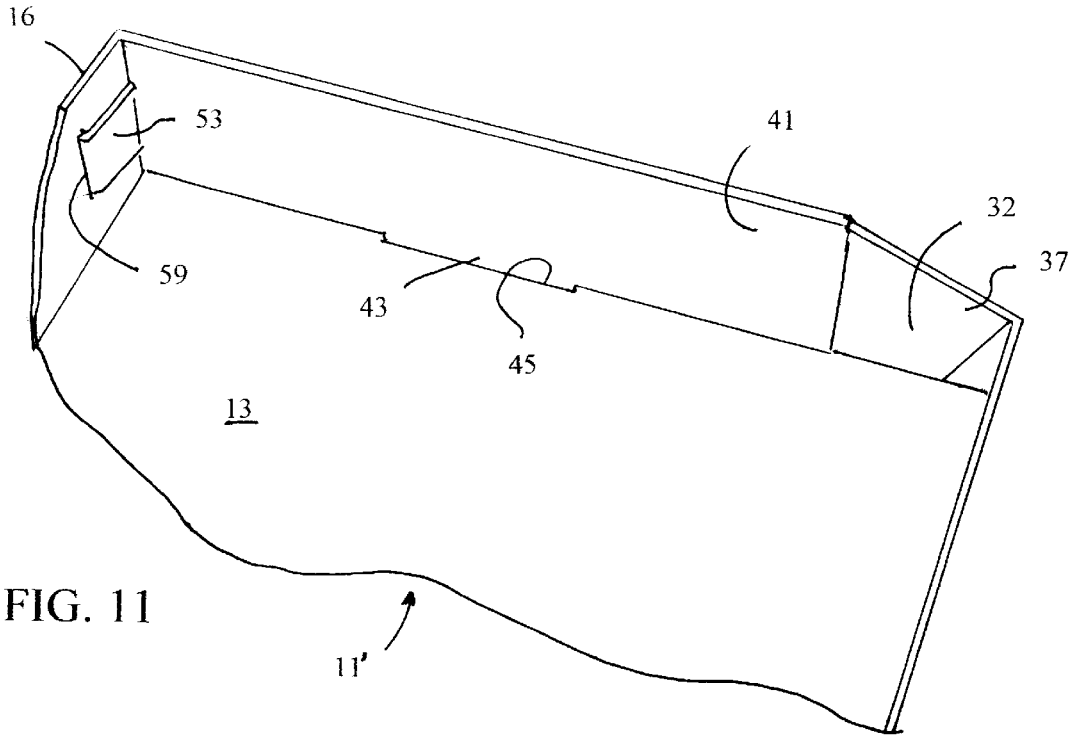
FIG. 11 is an enlarged fragmentary top perspective view of one side of the tray of the invention, shown in fully folded or erected condition.
Figure 12:
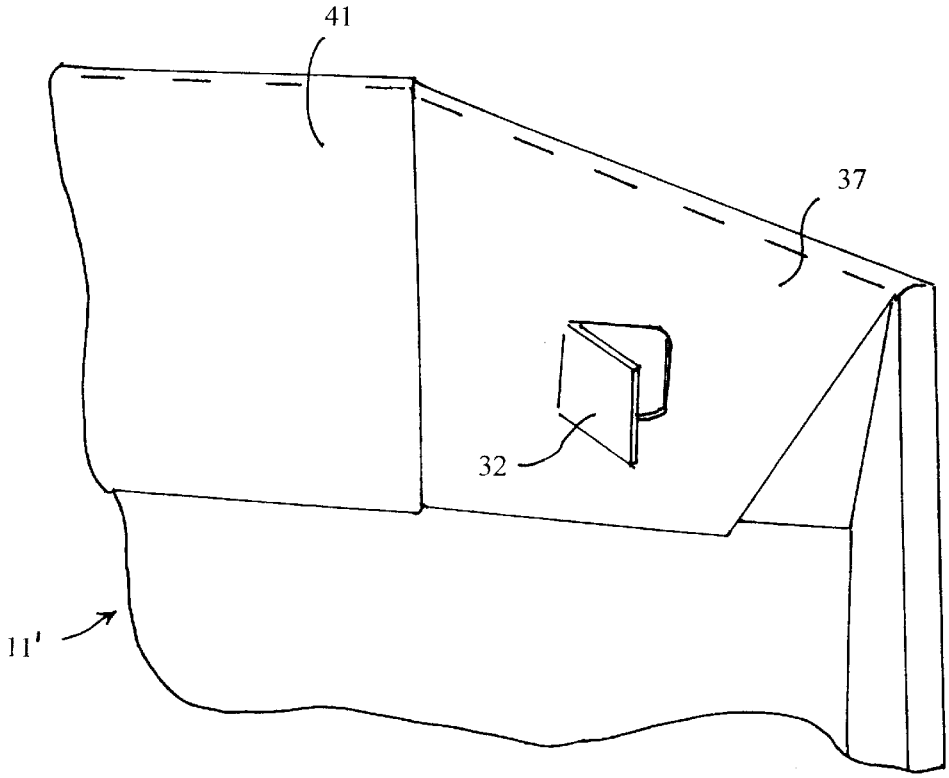
FIG. 12 is a greatly enlarged, fragmentary top perspective view of a front corner of the tray of the invention, showing the retaining means for one of the elastic members.

A container according to the invention is indicated generally at 30 in FIGS. 4, 5 and 6. This container comprises a tray 11' and insert 12 substantially identical to the prior art tray and insert described above, except that the tray 11' is modified to include attachment tabs 31 and 32 for elastic or resiliently yieldable members 33 and 34 that are connected between the tray and a pusher member 35 that slides on top of the insert and is resiliently urged in a forward direction by the resiliently yieldable members 33 and 34 (see FIGS. 6 and 13–16. The pusher member 35 thus continually urges the items 20 forwardly to replace items removed by customers from the front of the container.

As seen best in FIGS. 6–12, 16 and 20, the attachment tabs 31 and 32 are formed in a pair of flaps 36 and 37 at respective opposite front corners of the tray. The tabs are struck from the flaps so that they have a free end facing toward the front of the tray and a hinged end toward the rear of the tray, whereby the elastic members 33 and 34 may be looped at one end over the tabs and retained by the tabs against rearward movement. When the insert 12 is placed in the tray, it lies against the tabs to hold them in a closed position to insure that the elastic members do not slip off the tabs when force is exerted on the elastic members. See FIG. 6 for example.

Figure 19:
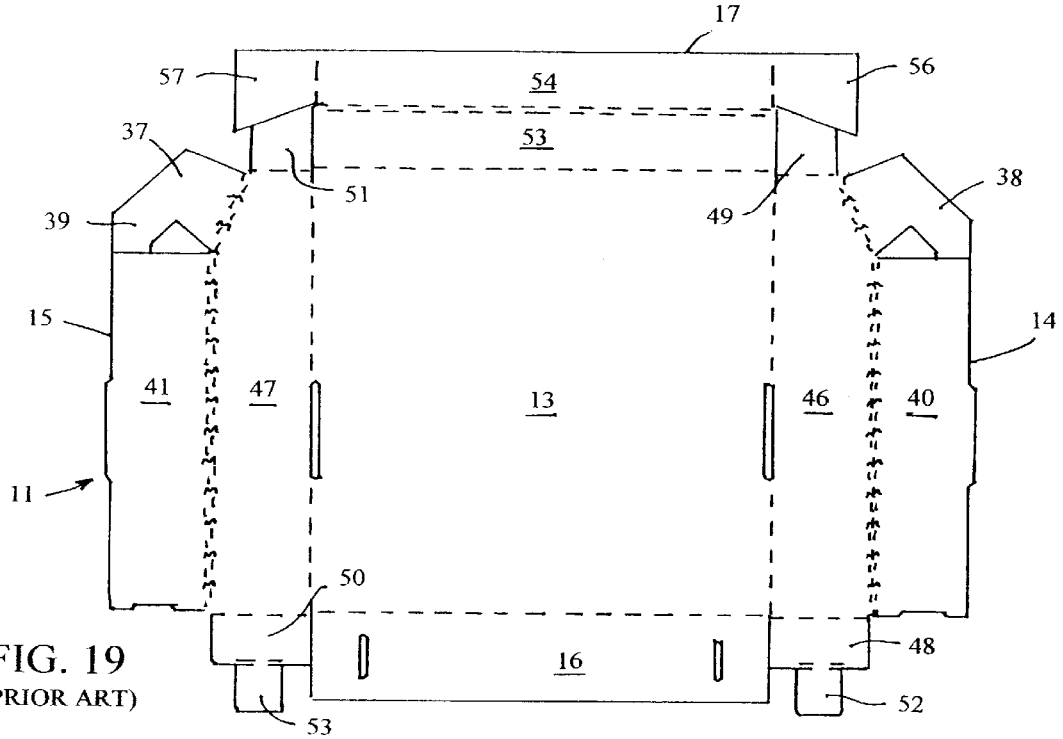
FIG. 19 (PRIOR ART)
FIG. 19 is a top plan view of a blank used to make a prior art tray.
Figure 20:
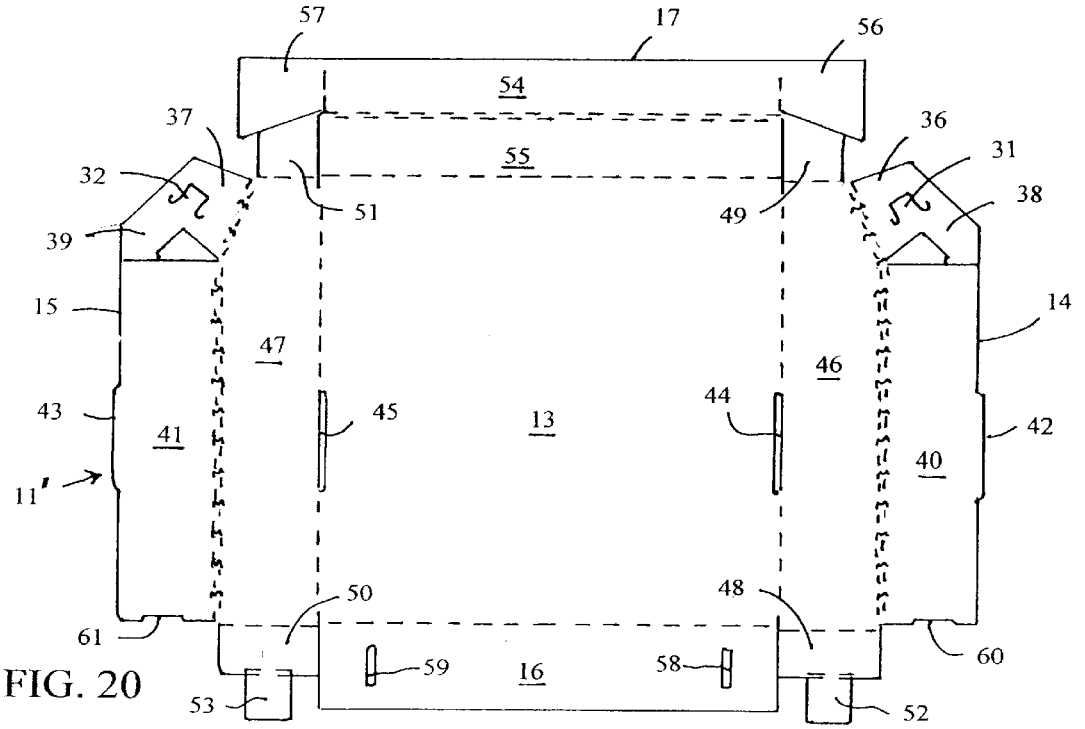
FIG. 20 is a top plan view of the blank used to make the tray of the invention.

FIG. 19 depicts a prior art blank 11 for forming a tray that is essentially identical to the blank 11' of FIG. 20, except that it lacks the tabs 31 and 32 that cooperate with the elastic members to move the pusher member 35 forwardly in the tray. The description of the remainder of the blank 11 is identical to the description of blank 11' in FIG. 20, and is not repeated herein.

The flaps 36 end 37 are held in their operative folded positions as shown in FIGS. 6–12 and 16 by elongate tabs 38 and 39, respectively, on the flaps 36 and 37, held behind respective inner panels 40 and 41 of the side walls 14 and 15. The inner side wall panels 40 and 41 are held in their operative folded position by engagement of tabs 42 and 43 on their free edges in slots 44 and 45 at the respective opposite side edges of bottom wall 13.

The front, side and back walls are held in their operative folded positions by several mutually interlocking flaps and tabs on adjacent ends of the panels forming the the side walls 14 and 15 also include outer panels 46 and 47, respectively, with flaps 48, 49 and 50, 51, respectively, projecting from opposite ends thereof. In addition, tabs 52 and 53, respectively, project from the free ends of flaps 48 and 50.

The front wall 17 also comprises inner and outer panels 54 and 55, respectively, and the inner panel 54 has flaps 56 and 57 projecting from opposite ends thereof.

The back wall 16 comprises a single panel, and has a pair of slots 58 and 59 therethrough adjacent opposite ends thereof.

To erect the tray 11', the inner side wall panels 46 and 47 are folded upwardly, with the flaps 49 and 51 at their respective forward ends lying inside the outer panel 55 of the front wall. The inner panel 54 of the front wall is then folded downwardly over the flaps 49 and 51, with the flaps 56 and 57 at opposite ends of the inner front wall panel lying alongside the inner surface of the outer side wall panels 46 and 47. The flaps 36 and 37 at the forward angled ends of the outer side wall panels 46 and 47 are then folded downwardly over the flaps 56 and 57 and into parallel relationship with the outer side wall panels 46 and 47, after which the inner side wall panels 40 and 41 are folded downwardly over the tabs 38 and 39 on flaps 36 and 37, with the tabs 42 and 43 on the edges of inner panels 40 and 41 engaged in slots 44 and 45.

Prior to folding the inner side wall panels 40 and 41 downwardly and inwardly as described above, the tabs 52 and 53 on the ends of flaps 48 and 50 at the rearward ends of inner side wall panels 46 and 47 are inserted through slots 58 and 59, respectively, in opposite end portions of the back wall 16 and then folded alongside the inner surface of the back wall and toward the adjacent side wall. When the inner side wall panels are folded downwardly, notches 60 and 61 in the rearward ends of inner side wall panels 40 and 41 receive the ends of tabs 52 and 53 to hold the tabs folded alongside the back wall 16, and thus hold the back wall in erected condition.

The insert 12 is then placed in the tray, with the top wall 18 thereof located at a height that is approximately one-half the height of the side walls of the tray. The insert and the mutually interengaged tabs and flaps on the respective front, back and side wall panels securely hold the tray in erected condition without the use of adhesives or other fasteners. As should be apparent from FIG. 6, the insert engages the tabs 31, 32 and 52, 53 to hold these tabs in their folded condition. This is particularly useful in connection with the tabs 31 and 32, since it prevents the elastic members from pulling these tabs rearwardly and thus prevents the elastic members from disengaging from the tabs.

The pusher member 35, as seen best in FIGS. 3 through 17, is made from a single blank and comprises a bottom panel 70, opposite end walls 71 and 72, and a back wall 73 comprised of inner and outer back wall panels 74 and 75, respectively. A pair of elongate flaps 76 and 77 is formed on the rearward edges of end walls 71 and 72, and tabs 78 and 79 are provided in these flaps, with a hinged end adjacent the folding connection between the flaps and respective end walls and a free end oriented toward the center of the pusher member. Locking tabs 80 and 81 are formed on the lower free edge of inner back wall panel 74 for engagement in slots 82 and 83 at the back edge of the bottom panel 70.

Figure 15:
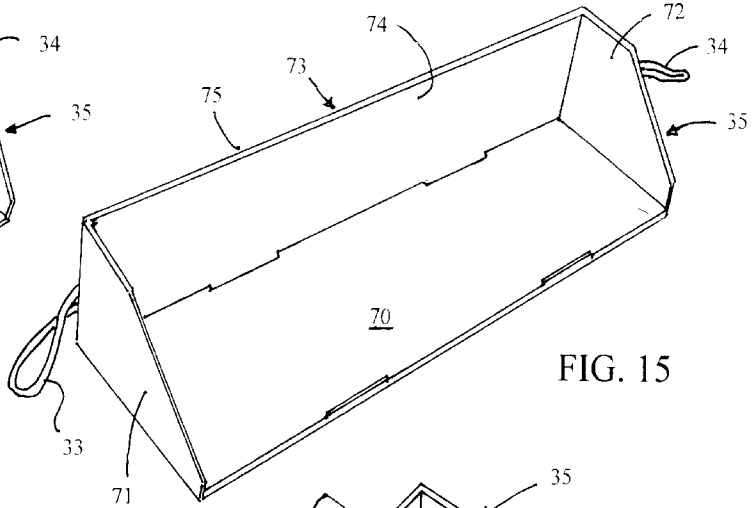
FIG. 15 is a top perspective view of the pusher member in fully erected condition.
Figure 16:
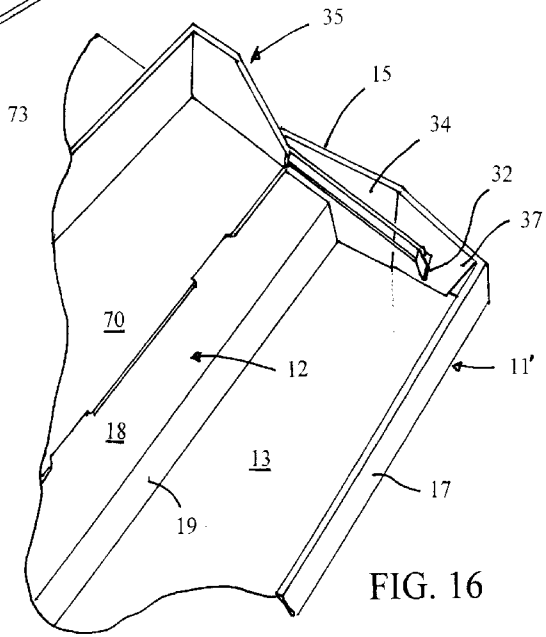
FIG. 16 is a fragmentary top perspective view of a front corner portion of the tray, with the insert partially removed to show the attachment of the elastic members with the tray and the pusher member.
Figure 13:
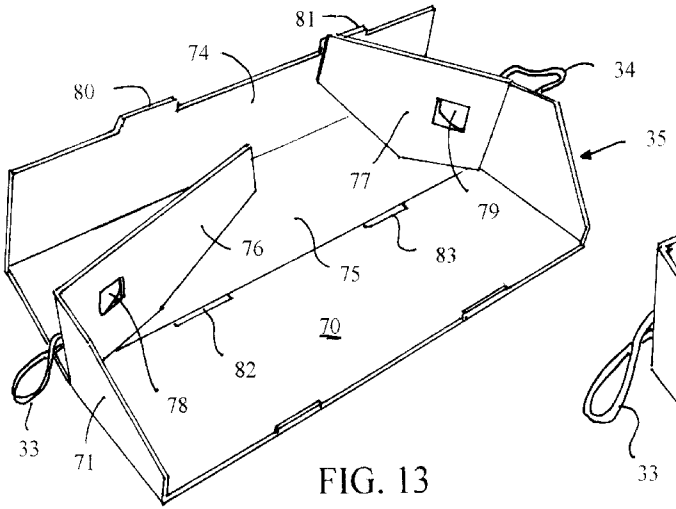
FIG. 13 is a front top perspective view of the pusher member of the invention, shown in unfolded condition.

To erect the pusher member 35, the end walls 71 and 72 are bent upwardly, with the flaps 76 and 77 bent inwardly, as seen in FIG. 13. The outer back wall panel 75 is then bent upwardly behind the flaps 76 and 77, and the inner back wall panel 74 is bent downwardly inside the flaps 76 and 77, with the tabs 80 and 81 engaged in the slots 82 and 83 to lock the pusher member in erected condition, as seen in FIG. 15.

Figure 14:
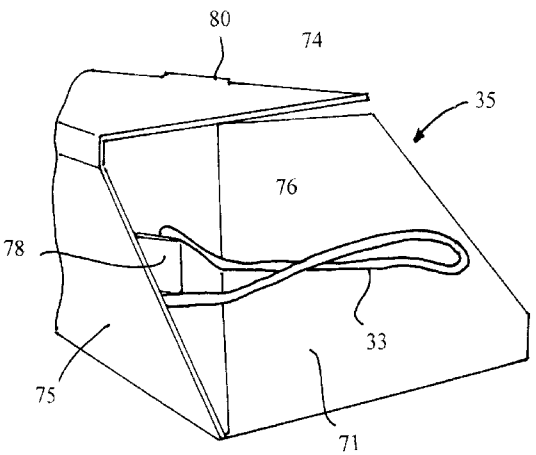
FIG. 14 is a slightly further enlarged fragmentary rear perspective view of the pusher member of FIG. 13, shown in partially folded or erected condition.
Figure 17:
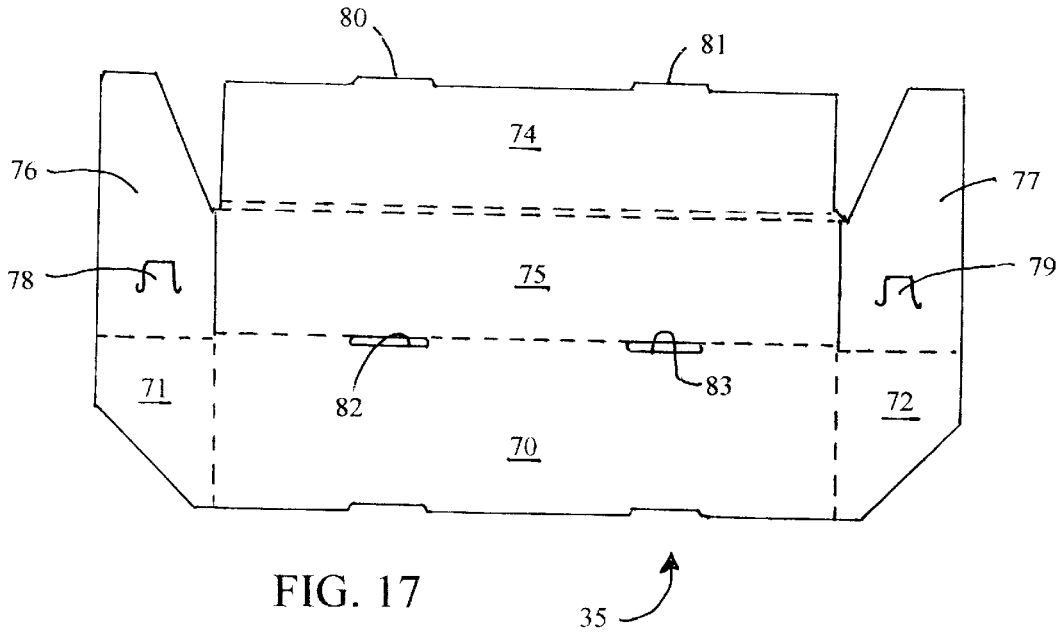
FIG. 17 is a top plan view of a blank used to made a first embodiment of the pusher member.

The pusher member is assembled to the tray by at least partially removing the insert 12 to gain access to the tabs 31 and 32 so that one end of the elastic members 33 and 34 can be placed over the tabs. The insert is then repositioned in the tray, and the other ends of the elastic members engaged on the tabs 78 and 79. This may be accomplished before the pusher member is fully erected, or the tabs 80 and 81 on the inner back wall panel may be disengaged from the slots 82 and 83 so that the inner and outer back wall panels can be displaced to gain access to the tabs 78 and 79, as shown in FIGS. 13 and 14.

To load the container with items for shipping and display, the pusher member is moved to the rear of the tray, applying tension on the elastic members, and the tray is then filled with items. The loaded container is then placed in an outer box (not shown) for shipping. Upon reaching its destination, the container loaded with items is removed from the shipping box and placed on a shelf or other display surface. As customers remove items from the front of the tray, the pusher member pushes the remaining items forwardly so that they are always disposed at the front of the container for better visibility and access.

The pusher member and the elastic members are constructed and connected so that the pusher member is movable completely rearwardly in the container until its back wall contacts the back wall of the tray, e.g., when the container is fully loaded with items, and is movable completely forwardly in the container until the forward edge of the bottom panel 70 engages the front wall of the container. In its forwardmost position, one or more articles may still be received between the pusher member and the front wall of the container.

Figure 18:
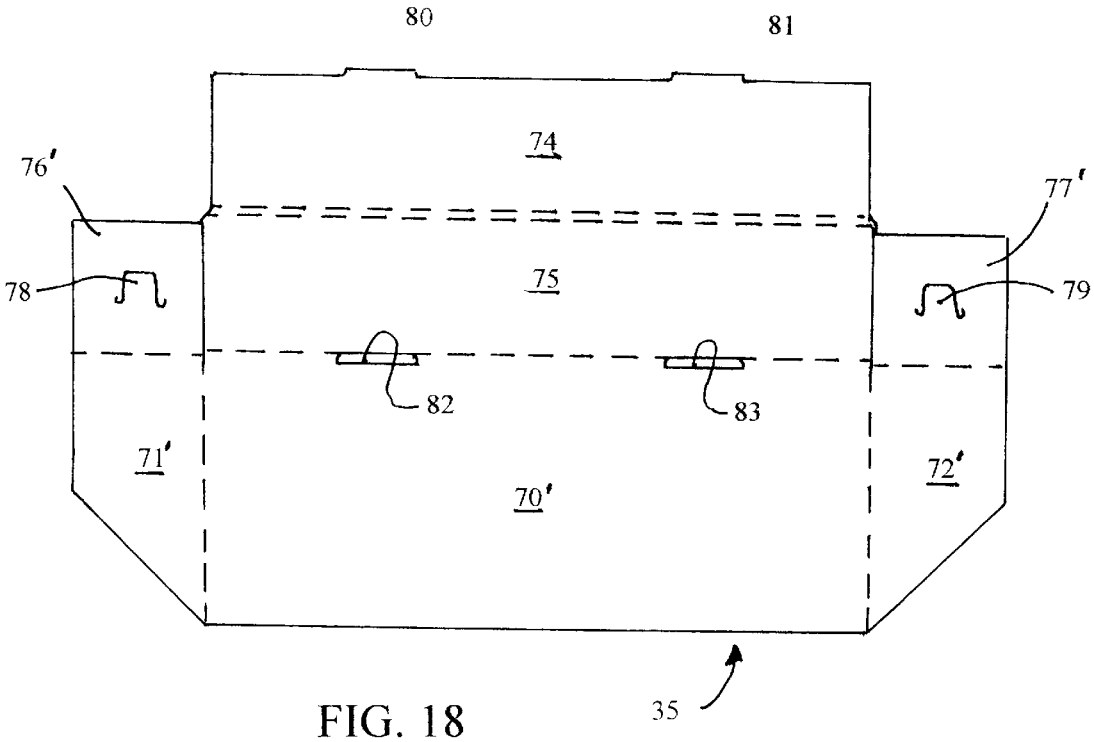
FIG. 18 is a top plan view of a blank used to make a second embodiment of the pusher member.

A blank for making a modified pusher member 35' is shown in FIG. 18. The modified pusher member is substantially identical to the pusher member 35 previously described and illustrated, differing therefrom in that the bottom panel 70' is deeper or longer in a direction from front-to-rear of the container, and the elongate tapered protrusions are omitted from the flaps 76' and 77'.

While particular embodiments of the invention have been illustrated and described in detail herein, it should be understood that various changes and modifications may be made to the invention without departing from the spirit and intent of the invention as defined by the scope of the appended claims.

What is claimed is:

1. A shipping and display container for shipping and displaying a plurality of articles, comprising:

a shallow, open-top tray with a flat, upwardly facing support surface and a narrow, upstanding peripheral wall around the support surface, said peripheral wall including a back wall, opposite side walls, and a front wall, which laterally retain articles on the support surface;

a pusher member slidable on the support surface from the back wall toward the front wall to push articles forward on the support surface toward the front wall to replace articles removed from the front;

said pusher member comprising a bottom panel lying flat against the support surface, an upstanding back wall, and opposite end walls, which together define a scoop shape that holds at least one article and which maintains an upright orientation on the support surface as it slides along the surface; and a pair of elastic bands connected between respective opposite ends of the pusher member and opposite sides of the tray to resiliently urge the pusher member forwardly on the support surface.

2. A shipping and display container as claimed in claim 1, wherein:

the support surface is on an insert placed in the tray.

3. A shipping and display container as claimed in claim 2, wherein:

the pusher member is made from a single piece of material.

4. A shipping and display container as claimed in claim 3, wherein:

the material is corrugated cardboard and the pusher member is folded from a single flat blank; and said blank includes panels, flaps and tabs that interlock with one another to hold the pusher member in erected condition without requiring the use of adhesives or other fasteners.

5. A shipping and display container as claimed in claim 4, wherein:

the pusher member includes opposite end walls, a back wall, and a bottom panel that extends parallel to the support surface.

6. A shipping and display container as claimed in claim 5, wherein:

said pusher member back wall includes inner and outer panels;

elongate flaps are foldably joined to rearward edges of the end walls of the pusher member and received between the inner and outer panels of the back wall; and attaching tabs are formed on the flaps for attachment of the elastic members to the pusher member.

7. A shipping and display container as claimed in claim 1, wherein:

the pusher member has a width dimension for simultaneously engaging and pushing a plurality of articles placed side-by-side.

8. A disposable, paperboard container for shipping, supporting and displaying a plurality of articles for sale, comprising:

a paperboard tray having a bottom support surface, a back wall, a front wall and opposite side walls, wherein the articles project above at least the front wall and are slidable in the tray toward the front wall;

a paperboard pusher member slidable on the bottom support surface in a direction from the back wall toward the front wall, said pusher member having opposite end walls, a back wall, and a bottom wall, defining a scoop-like shape capable of receiving at least one article, and wherein the end walls slide in close proximity to the tray side walls, and the bottom wall slides along the bottom support surface, whereby the pusher member remains in a stable orientation as it moves forward in the tray; and elastic means connected between opposite ends of the pusher member and the tray to resiliently urge the pusher member and any articles in the tray forwardly, whereby as articles are removed from the front of the container other articles are pushed forward to replace the removed articles.

9. A container as claimed in claim 8, wherein:

the elastic means comprises an elastic band connected between each of the opposite ends of the pusher member and an adjacent side of the tray.

10. A container as claimed in claim 9, wherein:

the bottom support surface is on an insert placed in the tray, said insert having depending flanges that support the bottom support surface in upwardly spaced relationship to the bottom of the tray, and said elastic bands are at least partially concealed by the insert.

11. A container as claimed in claim 10, wherein:

the pusher member is folded from a single piece of paperboard, and a small tab is formed in each end wall, said tabs projecting outwardly toward an adjacent side wall of the tray and rearwardly toward the tray back wall; and said elastic bands are loops having one end engaged on the tabs to exert a force on the pusher member urging it forwardly in the tray.

12. A shipping and display container, comprising:

a support surface in the container for supporting a plurality of items in position for optimum visibility and accessibility to a customer or potential customer, said support surface having a longitudinal axis extending between a front edge and a rear edge of the container;

a pusher member mounted for sliding movement on the support surface in a direction parallel to the longitudinal axis, said pusher member made from a single piece of corrugated cardboard folded to have opposite end walls positioned at opposite sides of the tray, a back wall, a bottom wall that extends parallel to the support surface, and panels, flaps and tabs that interlock with one another to hold the pusher member in erected condition without requiring the use of adhesives or other fasteners, said back wall including inner and outer panels, and elongate flaps foldably joined to rearward edges of the end walls and received between the inner and outer panels of the back wall, said flaps having attaching tabs formed thereon; and an elastic biasing member connected between the container and the attaching tabs at each of the opposite ends of the pusher member to yieldably urge the pusher member forward in the container, whereby items placed in the container and supported on the support surface are continually urged forward by the pusher member to replace items removed from the front of the container by a customer.

* * * * *